US009676075B2

(12) United States Patent
Economikos et al.

(10) Patent No.: US 9,676,075 B2
(45) Date of Patent: Jun. 13, 2017

(54) METHODS AND STRUCTURES FOR ACHIEVING TARGET RESISTANCE POST CMP USING IN-SITU RESISTANCE MEASUREMENTS

(71) Applicant: GLOBALFOUNDRIES INC., Grand Cayman (KY)

(72) Inventors: Laertis Economikos, Wappingers Falls, NY (US); Elliott P. Rill, San Jose, CA (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 195 days.

(21) Appl. No.: 14/737,915

(22) Filed: Jun. 12, 2015

(65) Prior Publication Data

US 2016/0361791 A1 Dec. 15, 2016

(51) Int. Cl.
*B24B 37/00* (2012.01)
*B24B 37/005* (2012.01)
*B24B 37/20* (2012.01)

(52) U.S. Cl.
CPC ..... *B24B 37/005* (2013.01); *B24B 37/20* (2013.01)

(58) Field of Classification Search
CPC ..... B24B 37/005; B24B 37/042; B24B 37/20; B24B 37/013; B24B 49/16; B24B 49/12; B24B 49/00
USPC ..... 451/5, 6, 41, 285–290
See application file for complete search history.

(56) References Cited

U.S. PATENT DOCUMENTS 4,793,895 A 12/1988 Kaanta et al.
5,308,438 A * 5/1994 Cote ..... B24B 37/013 216/86
5,321,304 A 6/1994 Rostoker
5,337,015 A 8/1994 Lustig et al.
5,667,629 A * 9/1997 Pan ..... B24B 37/013 156/345.13
5,911,619 A * 6/1999 Uzoh ..... B24B 37/26 204/224 M
6,072,313 A 6/2000 Li et al.
6,257,953 B1 7/2001 Gitis et al.
6,319,420 B1 11/2001 Dow
6,368,184 B1 4/2002 Beckage
6,379,223 B1 * 4/2002 Sun ..... B23H 5/08 257/E21.304
6,517,669 B2 * 2/2003 Chapman ..... H01J 37/32963 156/345.25
6,558,229 B2 5/2003 Kimura et al.
6,624,642 B1 9/2003 Lyons et al.
6,837,983 B2 1/2005 Duboust et al.
7,083,495 B2 8/2006 Lin et al.
7,520,968 B2 4/2009 Mavliev et al.
(Continued)

FOREIGN PATENT DOCUMENTS

WO 0178945 A1 10/2001

*Primary Examiner* — George Nguyen
(74) *Attorney, Agent, or Firm* — Yuanmi Cai; Hoffman Wanrick LLC

(57) ABSTRACT

Various particular embodiments include a method for controlling chemical mechanical polishing, including: polishing a semiconductor wafer in a chemical mechanical polishing (CMP) tool; measuring a resistance of a resistive pathway through the semiconductor wafer while the semiconductor wafer is undergoing polishing in the CMP tool; and terminating the polishing of the semiconductor wafer when the measured resistance reaches a target resistance.

15 Claims, 9 Drawing Sheets

(56) References Cited

U.S. PATENT DOCUMENTS

| | | | | |
|---|---|---|---|---|
| 2004/0166773 | A1* | 8/2004 | Tada | B24B 49/10 451/8 |
| 2004/0214510 | A1* | 10/2004 | So | B23H 5/08 451/41 |
| 2005/0191858 | A1* | 9/2005 | Fukunaga | B24B 37/013 438/691 |
| 2008/0156773 | A1 | 7/2008 | Kitade et al. | |

* cited by examiner

METHODS AND STRUCTURES FOR ACHIEVING TARGET RESISTANCE POST CMP USING IN-SITU RESISTANCE MEASUREMENTS

TECHNICAL FIELD

The subject matter disclosed herein relates to integrated circuits. More particularly, the subject matter relates to methods and structures for achieving a target resistance post chemical mechanical polishing (CMP) using in-situ resistance measurements.

BACKGROUND

In semiconductor devices, interconnects (e.g., lines, vias) are typically formed using a damascene process in which a metal layer (e.g., copper, tungsten, etc.) is deposited in an opening etched into one or more dielectric layers on a substrate. Several chemical mechanical polishing (CMP) steps are performed during the damascene process. One such CMP step is used to remove a barrier layer and to planarize the metal layer and a top dielectric layer until the metal layer becomes coplanar with the top dielectric layer. This CMP step is typically performed for a fixed time, which often results in a high variability from wafer to wafer in the resistance of the metal interconnects that are formed.

SUMMARY

A first aspect includes a method for controlling chemical mechanical polishing, including: polishing a semiconductor wafer in a chemical mechanical polishing (CMP) tool; measuring a resistance of a resistive pathway through the semiconductor wafer while the semiconductor wafer is undergoing polishing in the CMP tool; and terminating the polishing of the semiconductor wafer when the measured resistance reaches a target resistance.

A second aspect includes a resistive pathway through a semiconductor wafer in a chemical mechanical polishing (CMP) tool, including: at least one through substrate via (TSV) formed in a substrate of the semiconductor wafer; at least one via formed in a metallization level of the semiconductor wafer; a conductive polishing pad of the CMP tool; and a conductive membrane of the CMP tool; wherein the semiconductor wafer is sandwiched between the conductive polishing pad and the conductive membrane of the CMP tool.

A third aspect includes a chemical mechanical polishing (CMP) tool, including: a resistance measuring system for measuring a resistance of a resistive pathway through a semiconductor wafer while the semiconductor wafer is undergoing polishing in the CMP tool; and a CMP control system for terminating the polishing of the semiconductor wafer when the measured resistance reaches a target resistance.

BRIEF DESCRIPTION OF THE DRAWINGS

These and other features of this invention will be more readily understood from the following detailed description of the various aspects of the invention taken in conjunction with the accompanying drawings that depict various embodiments of the invention.

DETAILED DESCRIPTION

As noted, the subject matter disclosed herein relates to integrated circuits. More particularly, the subject matter relates to methods and devices for achieving a target resistance post chemical-mechanical polishing (CMP) using in-situ resistance measurements.

In embodiments, portions of an in-situ resistance measurement system (hereafter "resistance measurement system") of the present disclosure may be formed in the kerf regions surrounding the semiconductor dies on a semiconductor wafer. The kerf regions are areas where the semiconductor wafer is cut to separate individual semiconductor dies when the fabrication process is complete. In other embodiments, portions of the resistance measurement system may be formed inside the semiconductor dies, as well.

Figure 1:
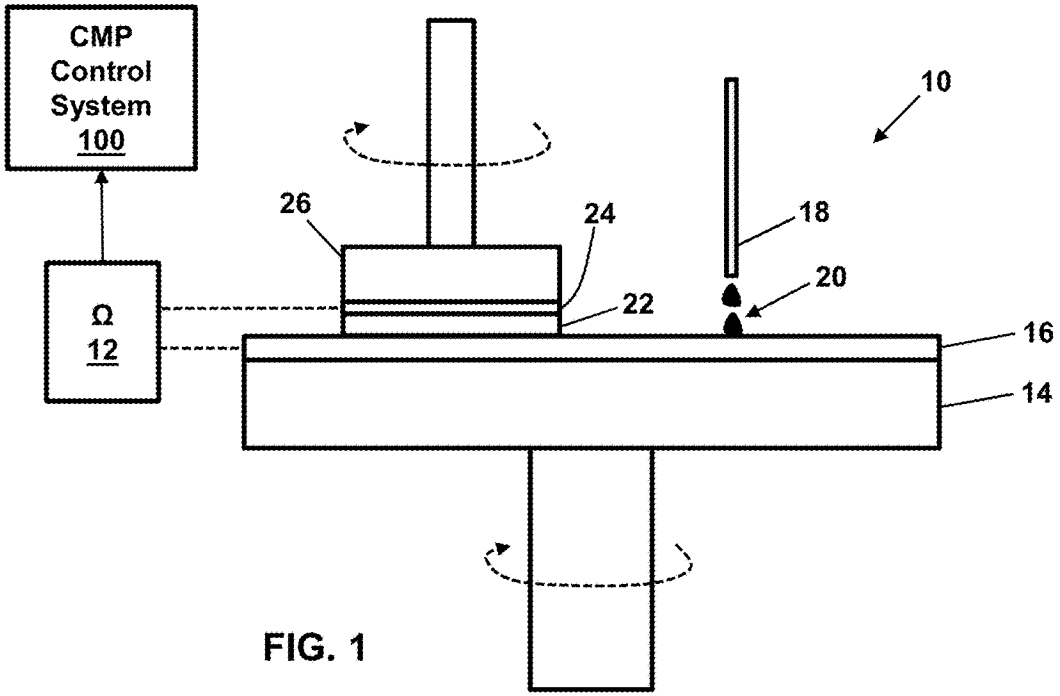
FIG. 1 is a cross-sectional view of a chemical mechanical polishing (CMP) tool including a resistance measurement system, according to embodiments.

A cross-sectional view of a chemical mechanical polishing (CMP) tool 10 including a resistance measurement system 12 according to embodiments is depicted in FIG. 1. The CMP tool 10 includes a rotatable platen 14 on which a conductive polishing pad 16 is positioned, and a slurry dispenser 18 for depositing a slurry 20 onto a surface of the polishing pad 16.

A semiconductor wafer 22 may be attached by a conductive membrane 24 to a rotatable carrier 26. In operation, the rotatable platen 14 and the rotatable carrier 26 are moved relative to one another. As the face of the semiconductor wafer 22 is moved across the surface of the conductive polishing pad 16, material is removed from the face of the semiconductor wafer 22.

The conductive polishing pad 16 and the conductive membrane 24 may be formed from a conductive material or may comprise one or more layers of a conductive material. Any suitable conductive material including, for example, copper, aluminum, gold, silver and tungsten, among others, may be utilized. As will be presented in further detail herein, the resistance measurement system 12 is configured to measure resistance values of a resistive pathway formed by the conductive polishing pad 16, the semiconductor wafer 22 being polished, and the conductive membrane 24. To this extent, the resistance values are measured by the resistance measurement system 12 while the semiconductor wafer 22 is located within and being polished by the CMP tool 10 (i.e., in-situ).

Figure 2:
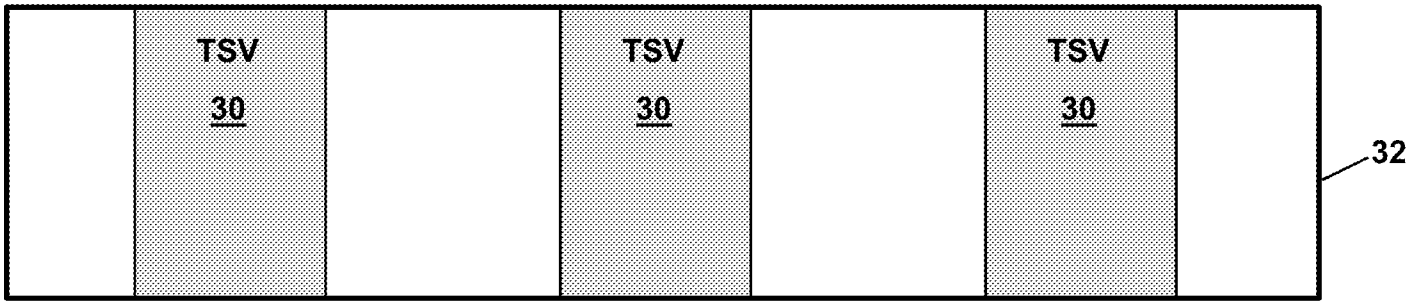
FIG. 2 depicts through substrate vias (TSV) in a substrate of a semiconductor wafer, according to embodiments.

According to embodiments, as depicted in FIG. 2, a plurality of through substrate vias (TSV) 30 are patterned (e.g., in kerf regions) in the substrate 32 of the semiconductor wafer 22 using standard semiconductor processing techniques. The substrate 32 may comprise, for example, silicon, while the TSVs may comprise, for example, copper. The pattern density of the TSVs 30 may be representative of the pattern density of the interconnects (e.g., lines) of the integrated circuit chips formed on the semiconductor wafer 22. For example, the pattern density of the TSVs 30 may be equivalent to the average pattern density of the interconnects of the integrated circuit chips formed on the semiconductor wafer 22.

Figure 3:
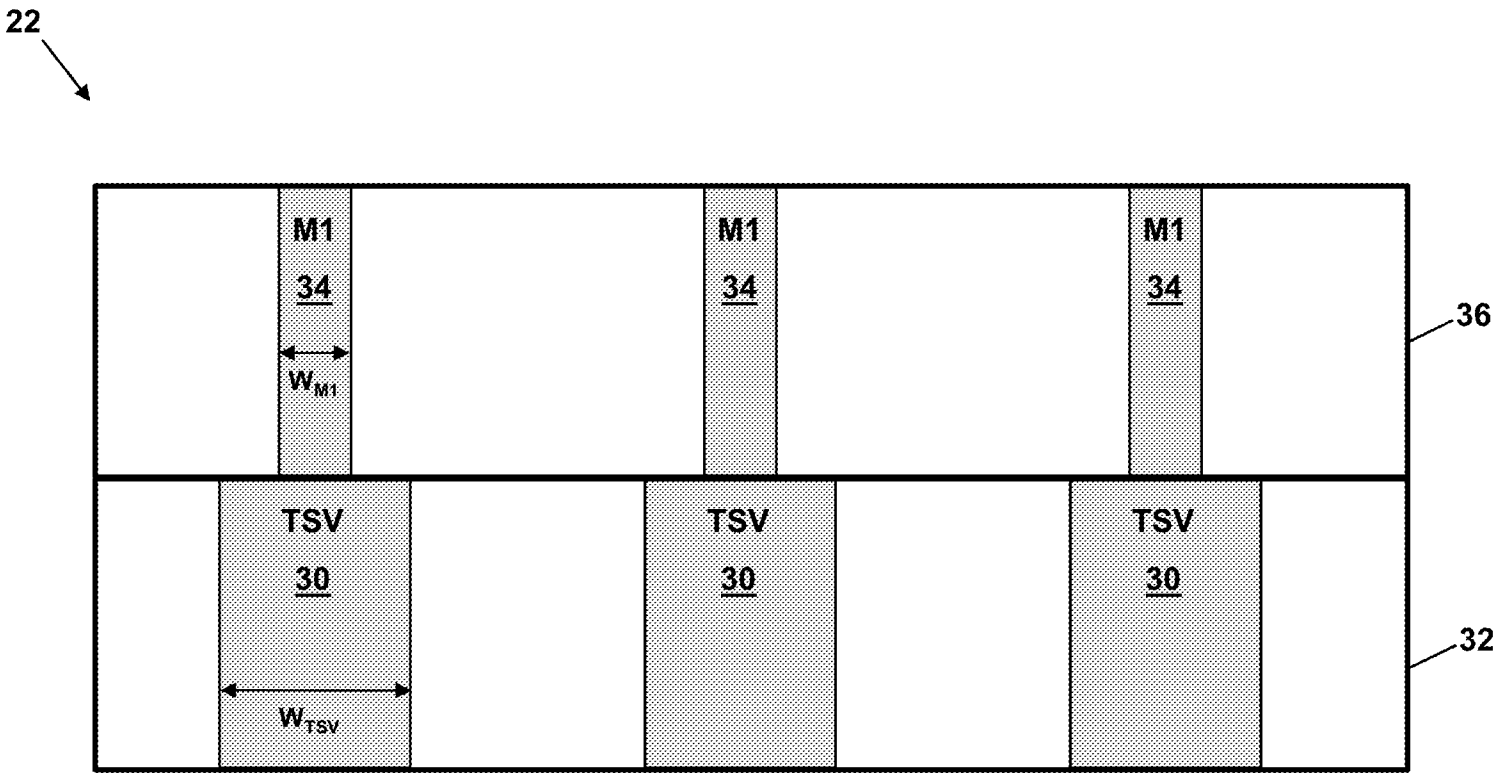
FIG. 3 depicts a plurality of vias formed over the TSVs, according to embodiments.

As shown in FIG. 3, after the formation of the TSVs 30, a plurality of vias 34 of a first metallization level (M1 level) are patterned in a dielectric layer 36 over the TSVs 30 previously formed in the substrate 32, with each via 34 contacting a TSV 30 in the adjoining layer. The dielectric layer 36 may comprise, for example, silicon dioxide, while the vias 34 may comprise, for example, copper. Other suitable materials may be used to provide the substrate 32, TSVs 30, vias 34, and dielectric layer 36.

Figure 4:
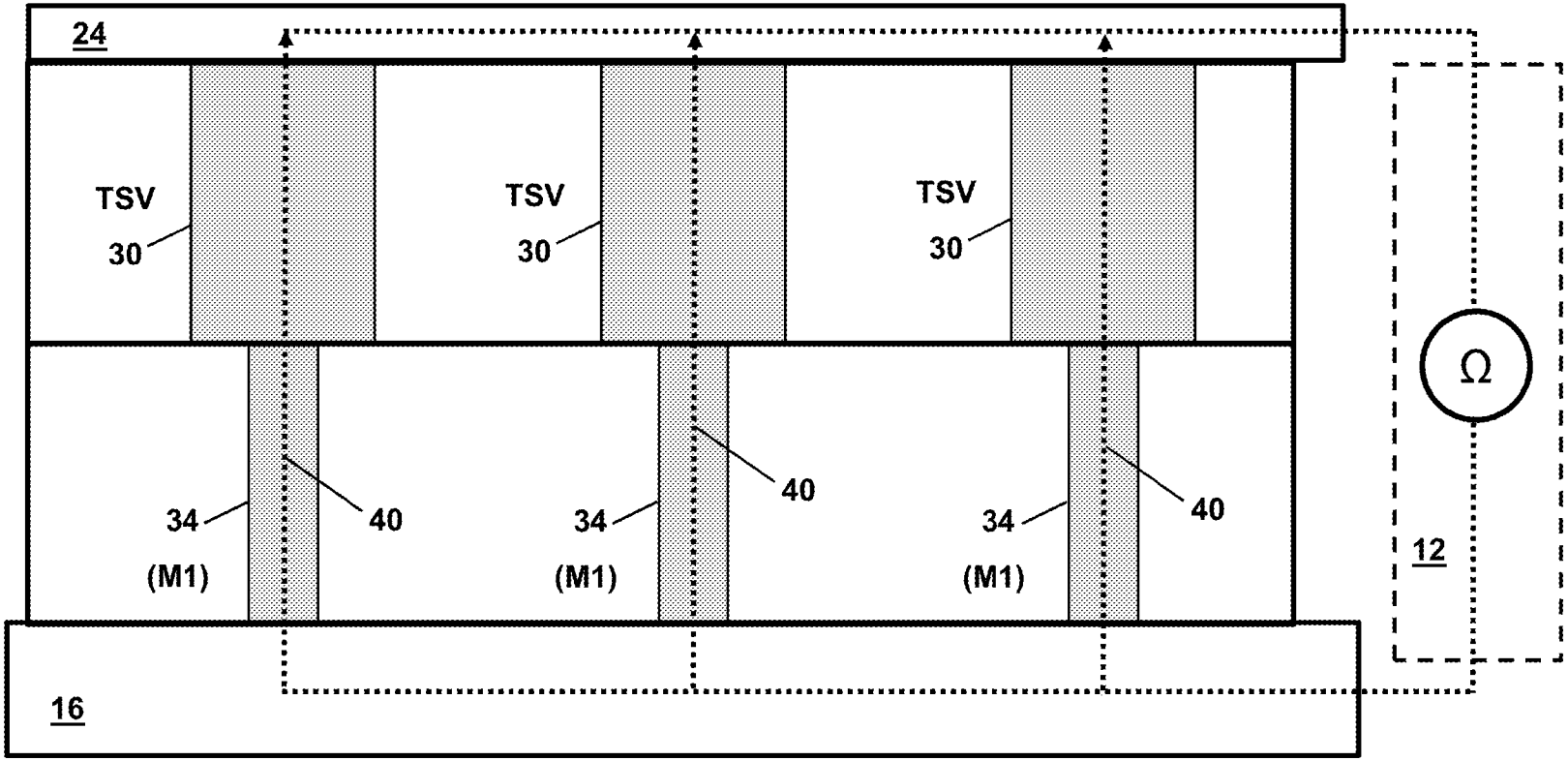
FIG. 4 depicts the structure of FIG. 3 being planarized by the CMP tool of FIG. 1 and a resistance measurement pathway formed by the conductive polishing pad and conductive membrane of the CMP tool through the TSVs and vias of the structure, according to embodiments.

In FIG. 4, the semiconductor wafer 22 is shown being planarized by the CMP tool 10. With the semiconductor wafer 22 sandwiched between the conductive polishing pad 16 and the conductive membrane 24, a resistance pathway 40 is formed in parallel through each set of TSVs 30 and vias 34. A resistance value $R_s$ of the resistance pathway 40 is measured by the resistance measurement system 12. Any suitable technique for measuring the resistance value $R_s$ may be used.

As the surface of the dielectric layer 36 and the top portion of the vias 34 are polished through the coaction of the conductive polishing pad 16 and slurry 20 of the CMP tool 10, the height of the vias 34 decreases. The reduction in the height of the vias 34 causes the resistance $R_s$ measured by the resistance measurement system 12 to increase. When the measured resistance $R_s$ reaches a target resistance value $R_t$, a CMP control system 100 (FIG. 1) terminates the polishing of the semiconductor wafer 22.

As depicted in FIG. 3, the critical dimension (CD) of the TSVs 30 ($W_{TSV}$) is larger than the critical dimension of the vias 34 ($W_{M1}$). This enhances the sensitivity of resistance measurements of the vias 34 made by the resistance measurement system 12, since most of the resistance of a via 34/TSV 30 structure is due to the thinner via 34. In embodiments, the vias 34 may be formed at a sub ground rule width (to increase sensitivity), while the TSVs 30 may be formed at a 3× ground rule width or greater.

Figure 5:
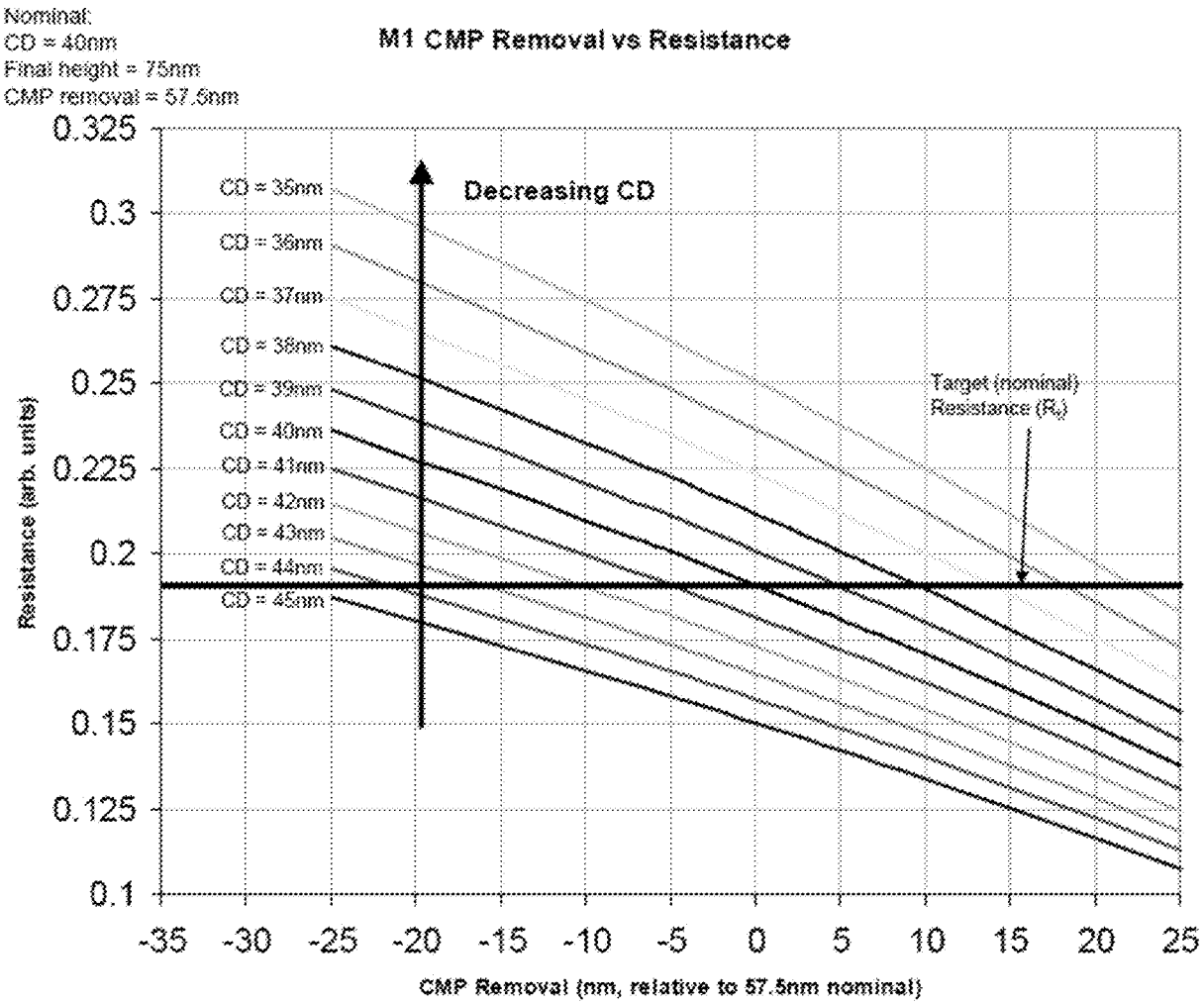
FIG. 5 is a chart depicting experimental values for CMP removal of an M1 metallization layer versus measured resistance for different critical densities, according to embodiments.

In embodiments, the target resistance value $R_t$ may be determined via experimentation. For example, a chart depicting experimental values for M1 CMP removal versus measured resistance $R_s$ for different CDs is depicted in FIG. 5. In this example, for a nominal case including a CD of 40 nm and a final via 34 height of 75 nm, 57.5 nm of material must be removed by the CMP tool 10 during this stage of the CMP process to obtain a nominal target resistance $R_t$ of about 0.190.

For a smaller CD (e.g., a CD of 39 nm), the target resistance $R_t$ of about 0.190 is achieved after 52.5 nm of material has been removed by the CMP tool 10 (i.e., +5 nm relative to the 57.5 nm nominal CMP removal). To this extent the final via 34 height is 80 nm. This results in a taller, but narrower via 34. Similarly, for a larger CD (e.g., a CD of 42 nm), the target resistance $R_t$ of about 0.190 is achieved after 67.5 nm of material has been removed by the CMP tool 10 (i.e., −10 nm relative to the 57.5 nm nominal CMP removal), resulting in a final via 34 height of 65 nm. This results in a shorter, but wider via 34. Thus, by using a constant target resistance $R_t$, the final resistance post CMP will remain constant, even if the CD changes (e.g., from wafer to wafer).

Figure 6:
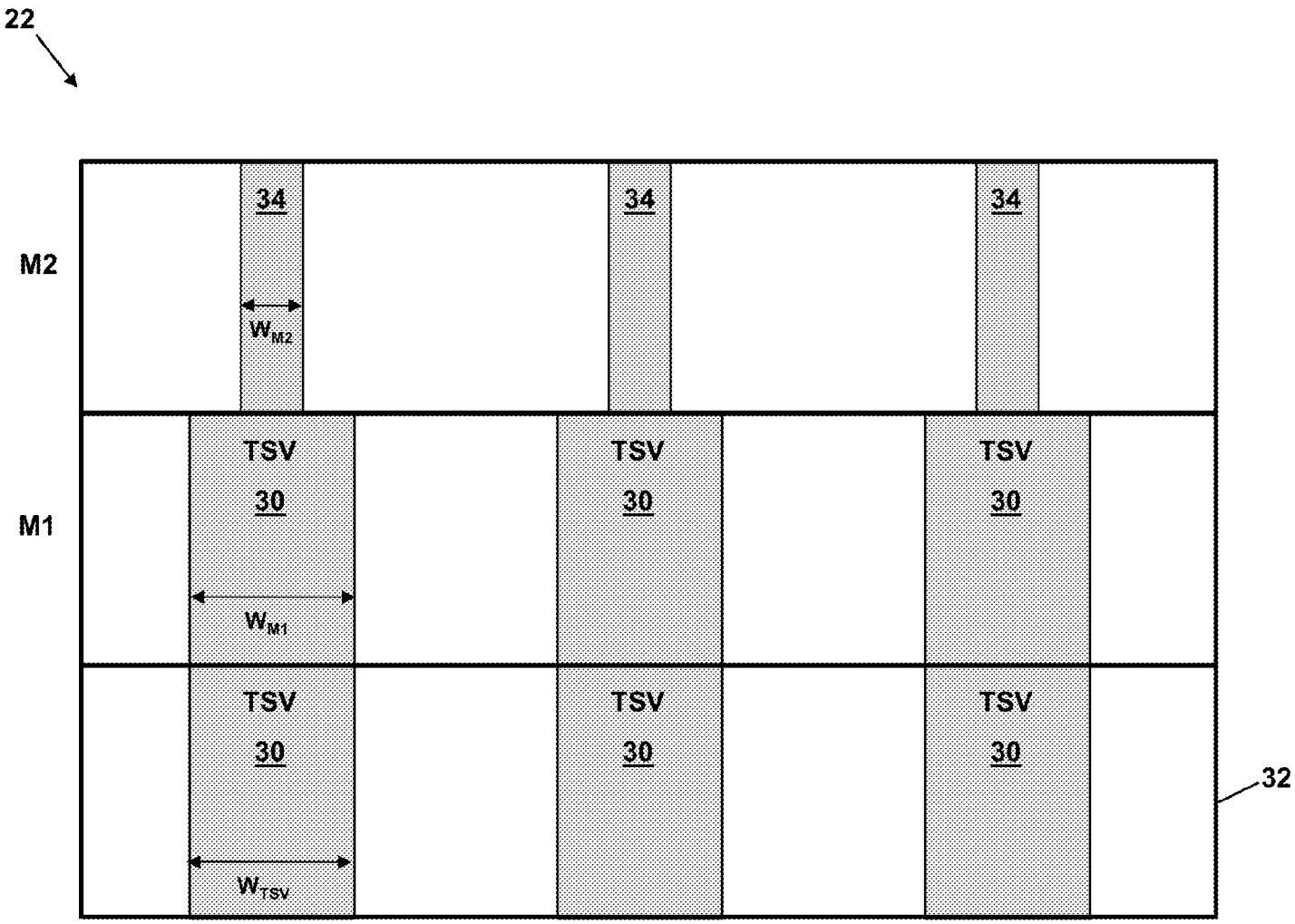
FIGS. 6 and 7 depict a plurality of vias formed over a plurality of levels of TSVs, according to embodiments.
Figure 7:
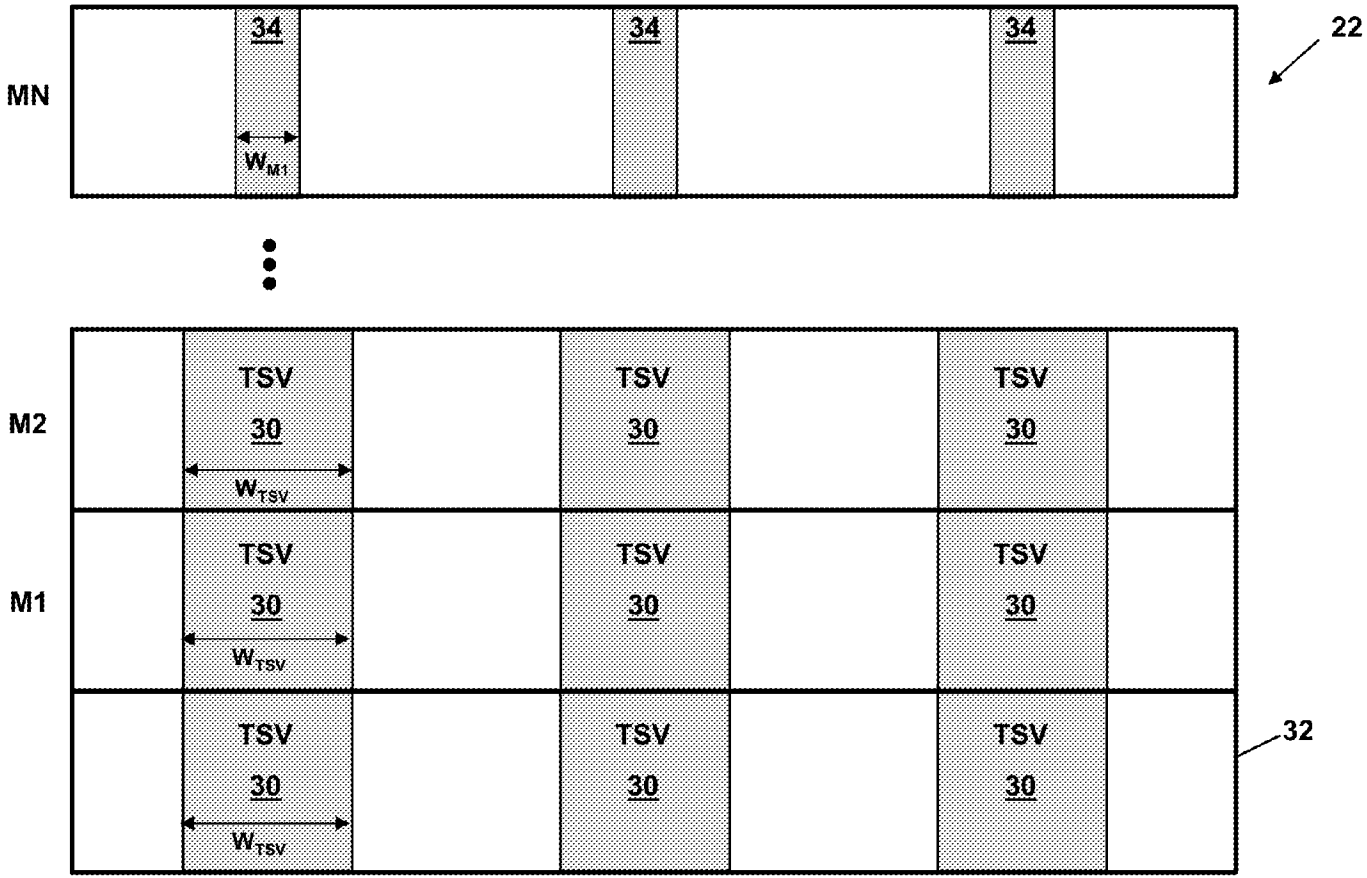

The process described above can be used during the CMP of additional metallization levels. For instance, as shown in FIG. 6, TSVs 30 may be patterned in the substrate 32 and in the M1 level, while vias 34 may be patterned in the second metallization (M2) level. In this case, the critical dimension (CD) of the TSV 30 ($W_{TSV}$) in the substrate and the TSV 30 ($W_{M1}$) in the M1 level are the same and are larger than the critical dimension of the vias 34 ($W_{M2}$) in the M2 level in order to increase the sensitivity of the resistance measurements of the vias 34. In embodiments, the vias 34 may be formed at a sub ground rule width (to increase sensitivity), while the TSVs 30 in the substrate and the M1 level may be formed at a 3× ground rule width or greater. During CMP of the vias 34 in the M2 level, the height of the vias 34 decreases, causing the resistance $R_s$ measured by the resistance measurement system 12 of the CMP tool 10 to increase. When the measured resistance $R_s$ reaches a target resistance value $R_t$, the polishing of the M2 level is terminated. This can be extended to a plurality of additional metallization levels as depicted in FIG. 7.

Figure 8:
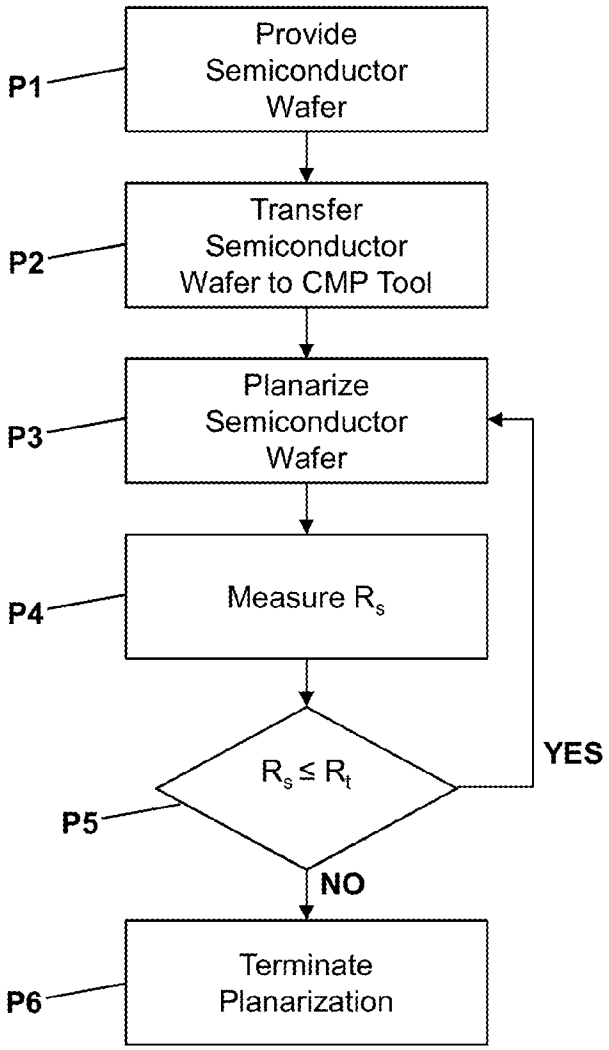
FIG. 8 is a flow diagram of a process for achieving a target resistance post CMP using in-situ resistance measurements, according to embodiments.

FIG. 8 is a flow diagram of a process for achieving a target resistance post CMP using in-situ resistance measurements, according to embodiments. In process P1, a semiconductor wafer 22 is provided. The semiconductor wafer includes a plurality of TSVs 30. A plurality of vias 34 are formed over the TSVs 30 (see, e.g., FIGS. 3, 6, and 7).

In process P2, the semiconductor wafer 22 with TSVs 30 and vias 34 is transferred to the CMP tool 10 for planarization. As depicted in FIG. 4, the semiconductor wafer 22 is sandwiched between the conductive polishing pad 16 and the conductive membrane 24. This forms a resistance pathway 40 in parallel through each set of TSVs 30 and vias 34. In process P3, the semiconductor wafer 22 is planarized by the CMP tool 10.

In process P4, the resistance measurement system 12 measures the resistance $R_s$ through the semiconductor wafer 22 (see, e.g., FIG. 4). If the measured resistance $R_s$ is less than a target resistance $R_t$ (YES, process P5), planarization continues. When the measured resistance $R_s$ reaches the target resistance $R_t$ (NO, process P5), planarization is terminated at process P6.

Figure 9:
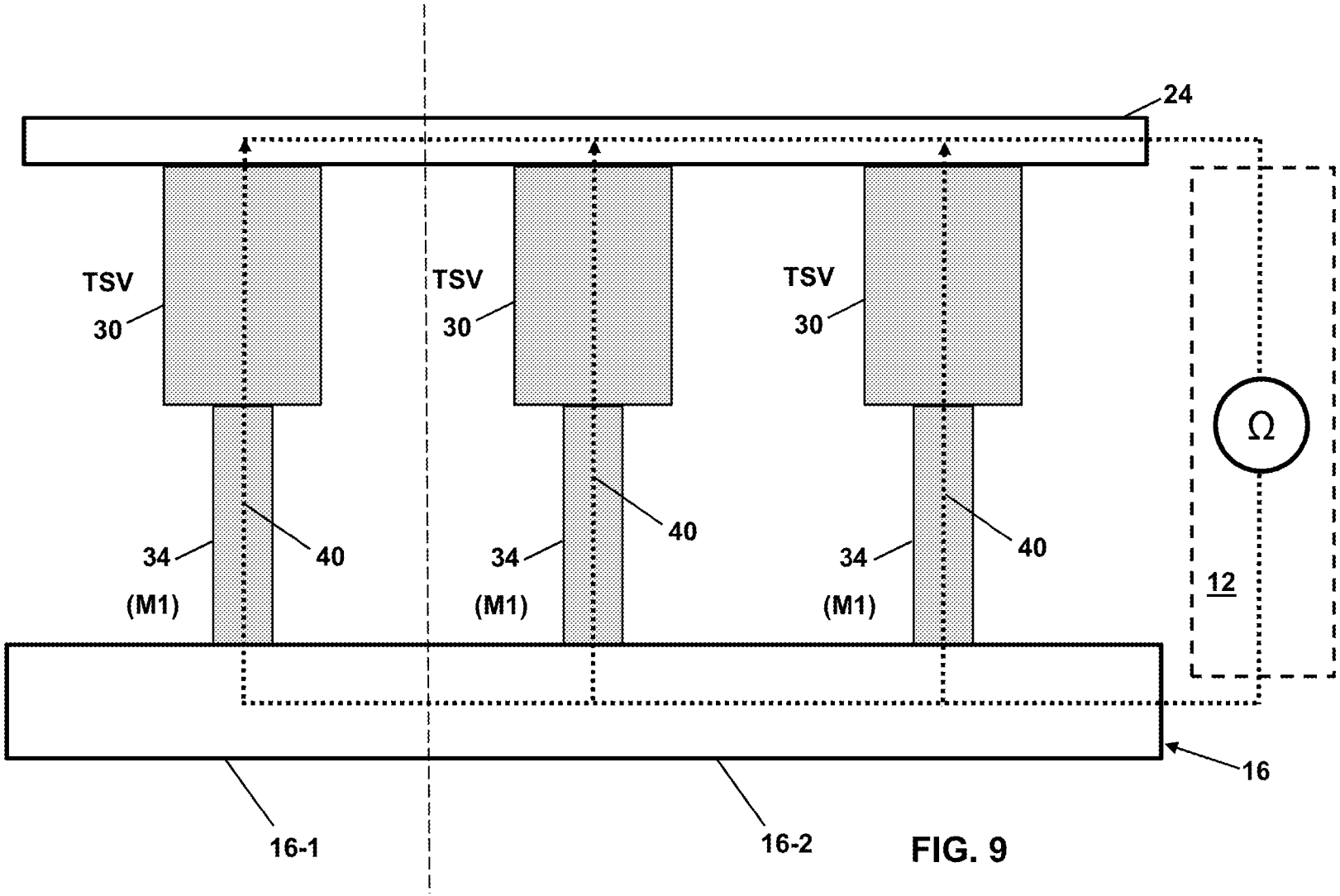
FIG. 9 depicts a segmented conductive polishing pad, according to embodiments.

As depicted in FIG. 9, the conductive polishing pad 16 may be divided into a plurality of segments. Although only two such segments 16-1, 16-2 are shown in FIG. 9, any number of segments may be used. Segmentation of the conductive polishing pad 16 allows the resistance change to be measured by the resistance measurement system 12 in separate zones across the semiconductor wafer 22 during planarization in the CMP tool 10. This data can be fed back to the CMP tool 10 and used, for example, to adjust the pressure applied by the polishing head on the wafer to better control planarization uniformity across the semiconductor wafer 22.

Various exemplary embodiments of via test structures have been disclosed herein. However, those skilled in the art should understand that the number of components (e.g., sensing lines, vias, terminals, etc.) in such via testing structures are not limited to those depicted in the Figures.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A method for controlling chemical mechanical polishing, comprising:

polishing a semiconductor wafer in a chemical mechanical polishing (CMP) tool;

measuring a resistance of a resistive pathway through the semiconductor wafer while the semiconductor wafer is undergoing polishing in the CMP tool, wherein the resistive pathway includes at least one through substrate via (TSV) formed in a substrate of the semiconductor wafer, at least one via formed in a metallization level of the semiconductor wafer, a conductive polishing pad of the CMP tool, and a conductive membrane of the CMP tool, wherein the semiconductor wafer is sandwiched between the conductive polishing pad and the conductive membrane of the CMP tool; and terminating the polishing of the semiconductor wafer when the measured resistance reaches a target resistance.

2. The method of claim 1, wherein the conductive polishing pad is divided into a plurality of segments, and wherein measuring the resistance further comprises measuring the resistance of a resistive pathway through each of the plurality of segments of the conductive polishing pad while the semiconductor wafer is undergoing polishing in the CMP tool.

3. The method of claim 1, wherein the at least one TSV has a critical dimension that is larger than a critical dimension of the at least one via.

4. The method of claim 1, wherein the at least one via is formed at a sub ground rule width, and wherein the at least one TSV is formed at a 3× ground rule width or greater.

5. The method of claim 1, wherein the resistive pathway through the semiconductor wafer is located in a kerf region of the semiconductor wafer.

6. The method of claim 1, further comprising:

polishing an additional semiconductor wafer in the CMP tool;

measuring the resistance of a resistive pathway through the additional semiconductor wafer while the additional semiconductor wafer is undergoing polishing in the CMP tool; and terminating the polishing of the additional semiconductor wafer when measured resistance reaches the target resistance.

7. A resistive pathway through a semiconductor wafer in a chemical mechanical polishing (CMP) tool, comprising:

at least one through substrate via (TSV) formed in a substrate of the semiconductor wafer;

at least one via formed in a metallization level of the semiconductor wafer;

a conductive polishing pad of the CMP tool; and a conductive membrane of the CMP tool;

wherein the semiconductor wafer is sandwiched between the conductive polishing pad and the conductive membrane of the CMP tool.

8. The resistive pathway of claim 7, wherein the at least one TSV has a critical dimension that is larger than a critical dimension of the at least one via.

9. The resistive pathway of claim 7, wherein the at least one via is formed at a sub ground rule width, and wherein the at least one TSV is formed at a 3× ground rule width or greater.

10. The resistive pathway of claim 7, wherein the at least one TSV and the at least one via are disposed in a kerf region of the semiconductor wafer.

11. A chemical mechanical polishing (CMP) tool, comprising:

a resistance measuring system for measuring a resistance of a resistive pathway through a semiconductor wafer while the semiconductor wafer is undergoing polishing in the CMP tool, wherein the resistive pathway includes at least one through substrate via (TSV) formed in a substrate of the semiconductor wafer, at least one via formed in a metallization level of the semiconductor wafer, a conductive polishing pad of the CMP tool, and a conductive membrane of the CMP tool, wherein the semiconductor wafer is sandwiched between the conductive polishing pad and the conductive membrane of the CMP tool; and a CMP control system for terminating the polishing of the semiconductor wafer when the measured resistance reaches a target resistance.

12. The CMP tool of claim 11, wherein the conductive polishing pad comprises a plurality of segments, and wherein the resistance measuring system measures the resistance of a resistive pathway through each of the plurality of segments of the conductive polishing pad while the semiconductor wafer is undergoing polishing in the CMP tool.

13. The CMP tool of claim 11, wherein the at least one TSV has a critical dimension that is larger than a critical dimension of the at least one via.

14. The CMP tool of claim 11, wherein the at least one via is formed at a sub ground rule width, and wherein the at least one TSV is formed at a 3× ground rule width or greater.

15. The CMP tool of claim 11, wherein the resistive pathway through the semiconductor wafer is located in a kerf region of the semiconductor wafer.

* * * * *